United States Patent [19]

Yagi et al.

[11] Patent Number: 4,524,562

[45] Date of Patent: Jun. 25, 1985

[54] METHOD AND APPARATUS FOR MAKING A CYLINDRICAL PACKAGE FOR STEEL STRIP COIL

[75] Inventors: Yoshio Yagi; Toshihiko Kondo; Norio Matsubara; Shoichiro Miyazaki; Hajime Kashiyama; Makoto Shibata, all of Kitakyushu, Japan

[73] Assignee: Yuwa Sangyo KK, Tokyo, Japan

[21] Appl. No.: 368,445

[22] Filed: Apr. 14, 1982

[30] Foreign Application Priority Data

Dec. 14, 1981 [JP] Japan ..... 56-203225

[51] Int. Cl.[3] ..... B65B 7/14; B65B 11/54; B65B 25/24

[52] U.S. Cl. ..... 53/409; 53/465; 53/204; 53/211; 53/378; 53/380; 53/480; 53/128; 53/410

[58] Field of Search ..... 53/211, 380, 409, 204, 53/378, 218, 465, 480, 128, 410

[56] References Cited

U.S. PATENT DOCUMENTS

| | | | |
|---|---|---|---|
| 2,746,224 | 5/1956 | Wollett | 53/380 X |
| 3,200,564 | 8/1965 | Lagesse | 53/380 |
| 3,296,772 | 1/1967 | Barker | 53/380 |
| 3,856,141 | 12/1979 | Reed | 53/409 |
| 4,095,395 | 6/1978 | Goldstein | 53/210 |
| 4,184,307 | 1/1980 | Kataoka | 53/380 |

FOREIGN PATENT DOCUMENTS

| | | | |
|---|---|---|---|
| 49189 | 4/1977 | Japan | 53/204 |
| 70690 | 6/1977 | Japan | 53/204 |

*Primary Examiner*—John Sipos

*Attorney, Agent, or Firm*—Wenderoth, Lind & Ponack

[57] ABSTRACT

A method and apparatus for making a cylindrical package in which a cylindrically shaped coil of a long steel strip having a peripheral surface, two end surfaces and a hollow cylindrical center is completely wrapped with a wrapping sheet material so as to have neatly folded closures on both end surfaces with a ring member inserted into the cylindrical hollow center of the coil. At first the wrapping sheet is wrapped around the coil so as to project from either end of the coil by a length l greater than the thickness t between the outermost layer and the innermost layer of the coil. The projecting portions are folded onto the end surfaces by pusher plates with pleat forming rods provided therebetween to form crease lines. The pleated portions of the sheet are flattened onto the folded sheet by the sliding action of pusher plates, and then a ring member is fitted into the cylindrical hollow center of the coil at either end with the edges of the folded sheet pressed underneath so that the wrapping is completed without use of an adhesive.

6 Claims, 20 Drawing Figures

METHOD AND APPARATUS FOR MAKING A CYLINDRICAL PACKAGE FOR STEEL STRIP COIL

BACKGROUND OF THE INVENTION

1. Field of the Invention

The present invention relates to a method and apparatus for making a cylindrical package for a steel strip coil in order to wrap the coil completely with a wrapping sheet material.

2. Description of the Prior Art

Cylindrically shaped coils of continuous steel strip are wrapped in a wrapping sheet material such as paper for protecting the surfaces, particularly the end surfaces, of the coil. In wrapping the peripheral surface and the two end surfaces of the coil with the wrapping paper, the paper has hitherto been manually folded onto the end surfaces from place to place and set rings have been fitted onto the folded end surfaces. However, the folding work performed in the above manner has required considerable skill and much time must be spent to complete the wrapping of the coil with the wrapping sheet material.

Wrapping machines for wrapping large rolls of paper and other paper products with a wrapping paper or the like are commercially available on the market. Also, a number of patents for such devices, such as U.S. Pat. Nos. 2,368,213, and 4,281,500 have been issued for such devices. However, no practical wrapping machine for completely covering a large heavy coil of a long continuous steel strip with a wrapping sheet material, such as paper or the like, has hitherto been available to the iron and steel industry.

SUMMARY OF THE INVENTION

Accordingly, it is the principal object of the invention to overcome the problem of wrapping steel sheet coils completely with a wrapping sheet material, and to provide a method for folding the portion of a wrapping material projecting beyond each end of the coil onto the end surface thereof.

It is an additional object of the invention to provide an apparatus for wrapping various steel coils of different diameters with a wrapping material, and folding the projecting portions of the wrapping material onto end surfaces of different diameters.

The present invention provides a method and apparatus for wrapping a heavy coil with a wrapping material wherein the peripheral surface and the end surfaces of the coil are quickly and precisely wrapped with the wrapping material with a neat, attractive folded end face at either end.

BRIEF EXPLANATION OF THE DRAWINGS

Other and further objects of the invention will become apparent from the following detailed description with reference to the drawings which, by way of example, illustrate two preferred embodiments of the invention, in which.

DETAILED DESCRIPTION OF THE INVENTION

The present invention will be described in detail with reference to the drawings.

Figure 1:
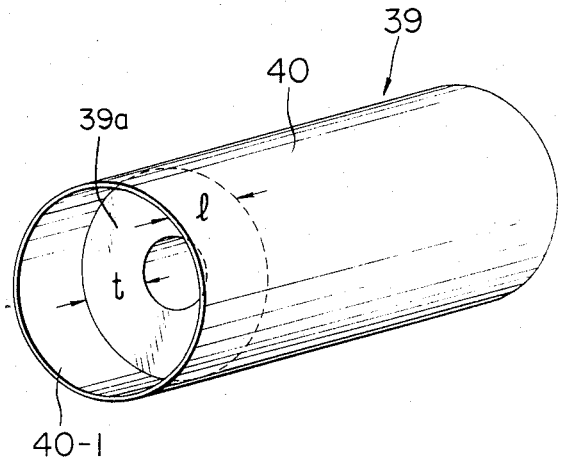
FIG. 1 is a perspective view of a cylindrical wrapper in which a steel coil is wrapped.

FIG. 1 shows a package 39 of a cylindrical wrapper 40 of a wrapping material, such as paper, within which a steel strip coil 39 is completely wrapped with the wrapping material and the wrapping 40 has a projecting portion 40-1 of a length l which projects beyond the end of the coil 39*a*. It is understood that the cylindrical wrapper 40 also has a projecting portion at the other end of the coil so that both end surfaces of the wrapper can be folded and finished in accordance with the present invention.

In the following description and the accompanying drawings, only one end surface of the package and wrapper is described. However, both end surfaces of the coil are similarly wrapped with the wrapping material.

It is seen that there is a cylindrical void in the center of the coil. At first, when a continuous length of steel strip is wound into a coil, a mandrel is provided as a spool for winding the strip. After the coiled product has been wound around the mandrel, the mandrel is withdrawn therefrom to leave this cylindrical void.

In FIG. 1, the thickness of the coil between the outermost layer and the innermost layer is designated by t (hereinafter referred to as the "coil thickness") and the portion of the wrapping material projecting beyond the end of the coil is designated by l (hereinafter referred to as the "projecting portion").

Figure 2:
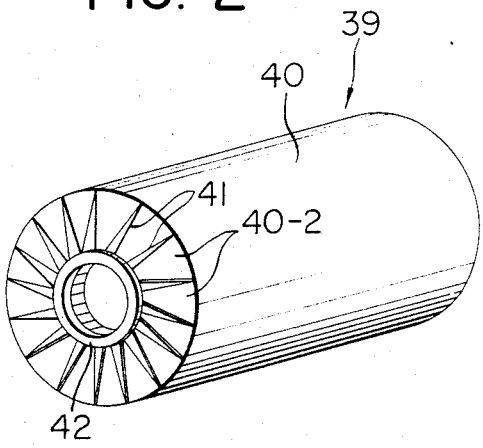
FIG. 2 is a perspective view showing the completely folded state of the end of the cylindrical wrapper on the end surface of the coil.

FIG. 2 is a perspective view showing a completed package 39 made in accordance with the method of the present invention. In the cylindrical package 39, the projecting portion l is folded to form the end surface 40-2 of the package, and a retaining ring 42 is fitted into the cylindrical void of the coil with the end of the folded wrapping material pressed underneath.

FIGS. 3–6 shows the construction of an apparatus for carrying out the method according to this invention. A tubular member 2 is provided which extends horizontally from a machine frame 1, and the base of the tubular member 2 is supported on frame 1 in such manner that it can be raised and lowered along two upright guides 3 by a cylinder 4. A rotatable tubular member 5 is fitted over the forward (lefthand) part of the tubular member 2 and is fixed against movement in the axial direction. An axially slidable tubular member 6 is fitted over the rotatable member 5.

A threaded rod 7 is mounted on a pair of bearings 8 within the tubular member 2 so as to lie along the axis a thereof, and a motor 9 is provided for rotating the threaded rod 7. An internally threaded member 10 for engaging with the threaded rod 7 is integrally connected to the slidable tubular member 6 by a connecting rod 11. The connecting rod 11 passes through a wide window 12 provided in the tubular member 2 and an axial slot 13 provided in the rotatable tubular member 5.

Sixteen arms 14 are provided on the outer periphery of the forward part of the rotatable tubular member 5. The base of each arm 14 is pivotally mounted on a pin 15 extending perpendicular to the axis a. Each of the sixteen arms 14 is connected to a boss 16 on the slidable member 6 by a connecting rod 17 so that the arms 14 can be opened and closed by sliding the slidable member 6 in the direction of axis a. All of the arms 14 are constructed in the same manner.

A trapezoidal pusher plate 18 is pivotally mounted on the forward end of each arm 14 by a hinge 19 attached to the outer surface of the pusher plate. The pusher plate 18 is further connected to the arm 14 by a spring 20. Thus, the force of the spring 20 urges the pusher plate 18 to extend forwardly from the tip of the arm 14 parallel to the axis a.

Sixteen threaded rods 21 each extending in the radial direction and supported by a pair of bearings 22 are provided at equal intervals around the base of the tubular member 2. A bevel gear 23 is provided at the inner end of each threaded rod 21 and meshes with the bevel gears 23 of the adjacent rods 21 (FIG. 6) so that all the threaded rods 21 can be simultaneously driven in the same direction by rotating a single rod 21 using a motor 24.

Each threaded rod 21 engages with an internally threaded member 25. Each internally threaded member 25 is provided with a small arm 26 which extends obliquely and is pivotally connected to the rear end of a pleat forming rod 27 at its distal end. The pleat forming rods 27 are located midway between adjacent pairs of pusher plates 18 and are maintained nearly parallel with the axis a.

A multiple stroke cylinder 30 is provided parallel to the axis a at the forward part of the tubular member 2. An insert member 33 having a tapered periphery 31 and a flange 32 is fixed to the multiple stroke cylinder 30. The insert member 33 can be advanced into and retracted from the void of the coil by the cylinder 30.

Insert member 33 is supported on the outer cylinder of a multiple cylinder 61 mounted on the end of tubular member 2 and having supporting rod 60 therein so as to be freely movable into and out of the coil.

The forward end of horizontal arm 34 (FIG. 4) is connected to the outer periphery of the slidable tubular member 6 via a conventional means (not shown) which converts the reciprocating motion of the arm 34 to rotating motion of the drum 6 while the other end of the horizontal arm 34 is connected to the cylinder 36. The ends of the cylinder 36 are provided with universal joints 35 respectively connected to rod 34 and frame 1 so that the cylinder 36 is able to follow the axial movement of the slidable tubular member 6. The horizontal arm 34 is raised and lowered by the reciprocation of the cylinder 36, and a revolving motion is given to the slidable tubular member 6 by the movement of the arm 34. Since the rotatable tubular member 5 is connected to the slidable tubular member 6 via the connecting rods 17 and arms 14, both members 5 and 6 are integrally revolved. The apparatus shown in FIG. 3 is further provided with rolls 37 for guiding the tubular member 2 during its ascent and descent.

In operation, a wrapping material having a length greater than the coil to be wrapped is laid on a stand 38. Then the steel coil is placed on the center of the wrapping material by a hoisting crane or the like so that the wrapping material extends beyond both ends of the coil. Then, the coil is completely wrapped around the peripheral surface of the coil to form a cylindrical wrapper 40 with projecting portions 40-1 at both ends. As mentioned hereinbefore, the length l of the projecting portion 40-1 is larger than the thickness t of the coil (FIG. 1).

Figure 3:
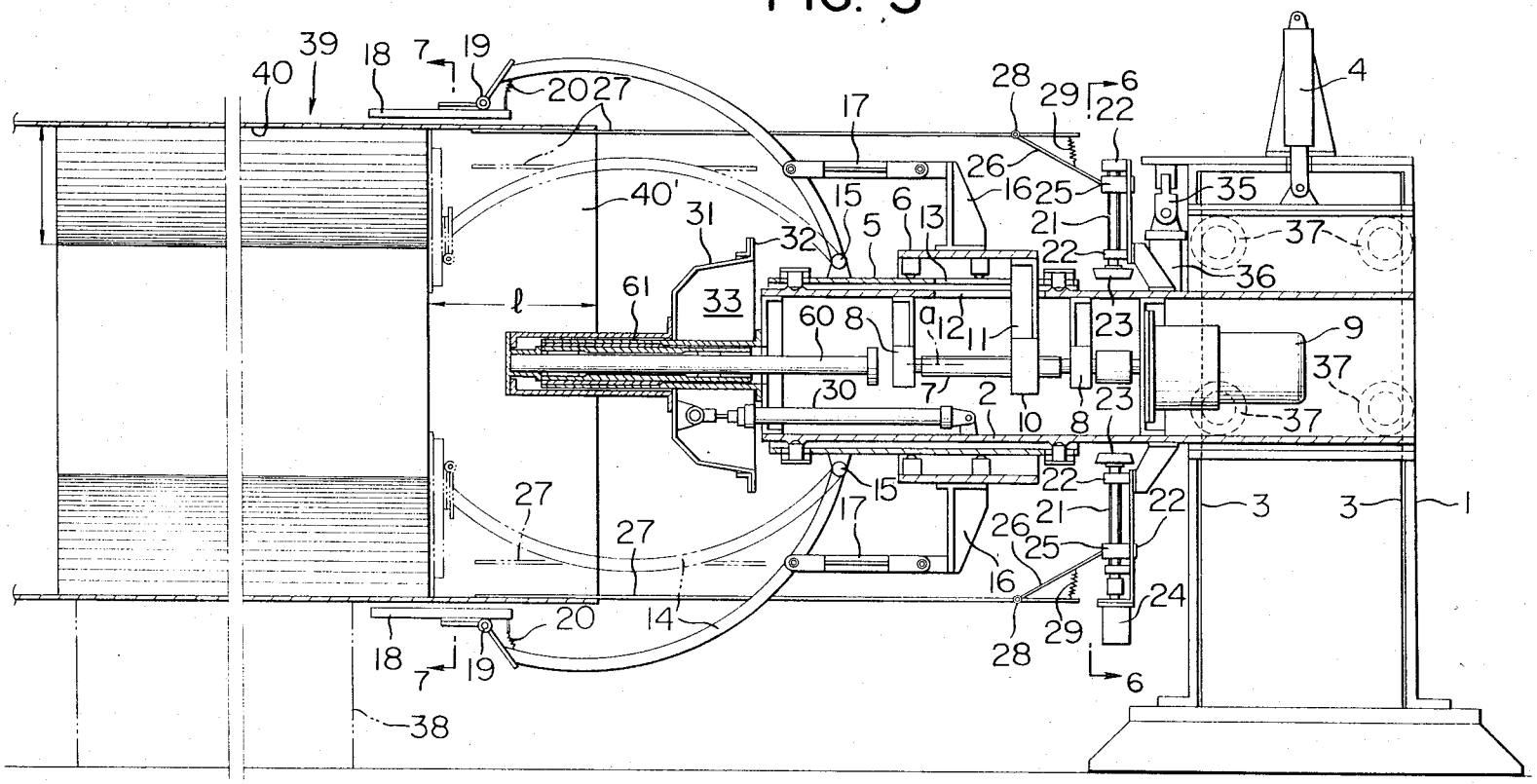
FIG. 3 is a side view, parly in section, of the overall construction of the apparatus of the invention.
Figure 4:
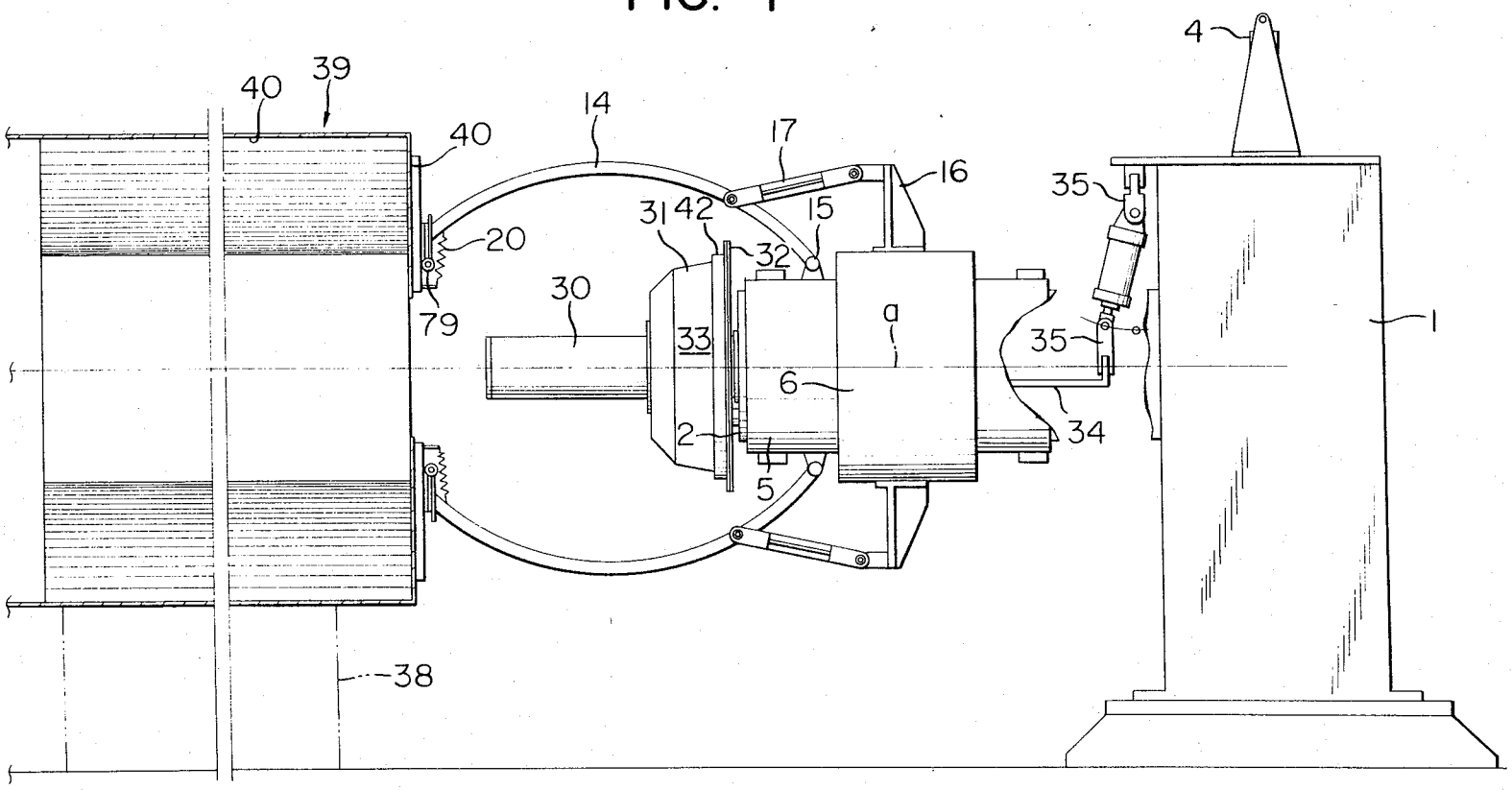
FIG. 4 is a side view of apparatus of FIG. 3 forming a folded end surface.

In this state, the stand 38 is moved to position the projecting portion 40-1 within the void defined by the inside surfaces of the sixteen pusher plates 18 when the sixteen arms 14 are opened fully as shown in solid lines in FIG. 3. The coil 39*a* is positioned so that the end thereof is approximately at the center of the pusher plates 18 in the axial direction.

During this positioning operation, the sixteen pleat forming rods 27 are set in the radially inward positions as indicated in broken lines in FIG. 3. After the alignment has been completed, the pleat forming rods 27 are moved outwardly to the radially outward positions shown in solid lines in FIG. 3 by rotating the motor 24. In this way the rods 27 are brought into contact with the inside of the projecting portion 40-1.

Figure 8:
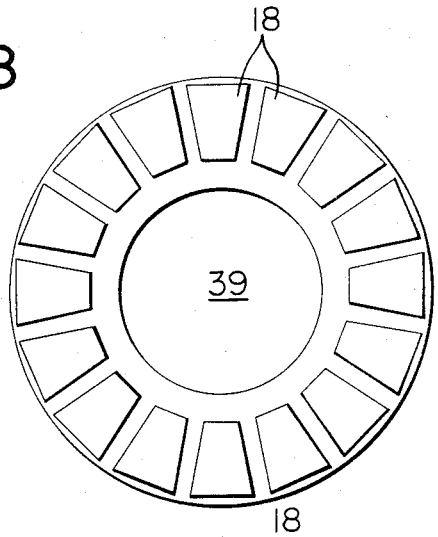
FIGS. 8–9 are end surface similar to FIG. 7 showing the action of pusher plates.
Figure 9:
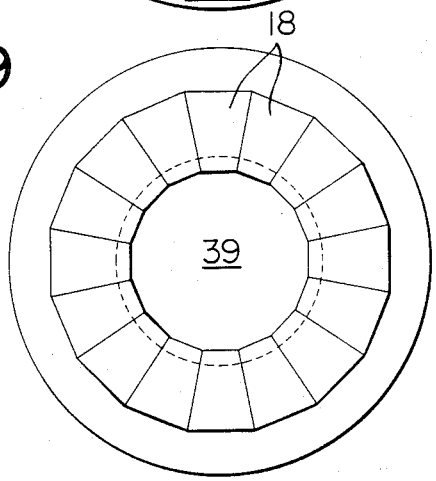
Figure 10:
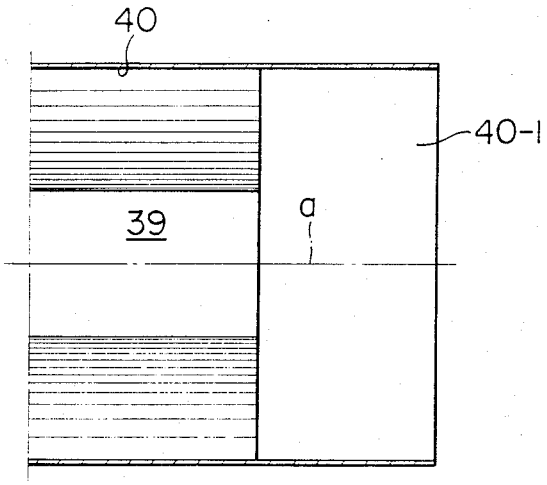
FIG. 10 is a longitudinal sectional view of the end portion of the wrapper of FIG. 1.
Figure 12:
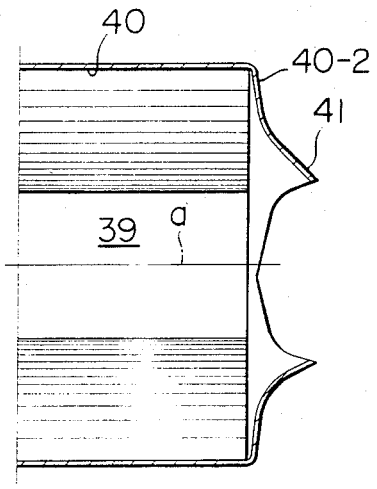
FIG. 12 is a longitudinal sectional view of the wrapper showing how to fold the projected portion of the wrapping material.
Figure 11:
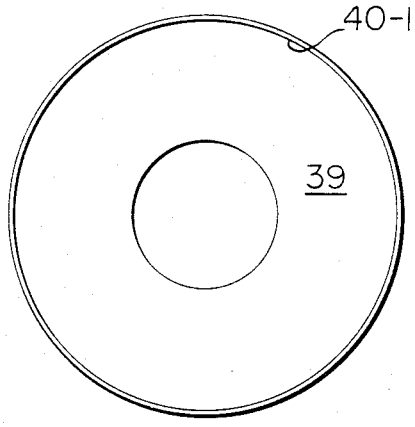
FIG. 11 is a front view of the end surface of the wrapper of FIG. 10 seen from the right in FIG. 10.
Figure 13:
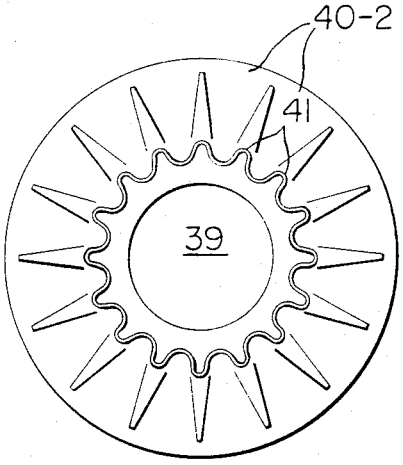
FIG. 13 is a front view of the end surface of the wrapper of FIG. 12.
Figure 14:
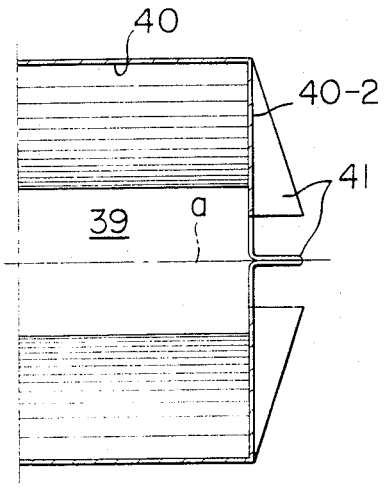
FIG. 14 is a view similar to FIG. 10 showing how to form one pleat.
Figure 15:
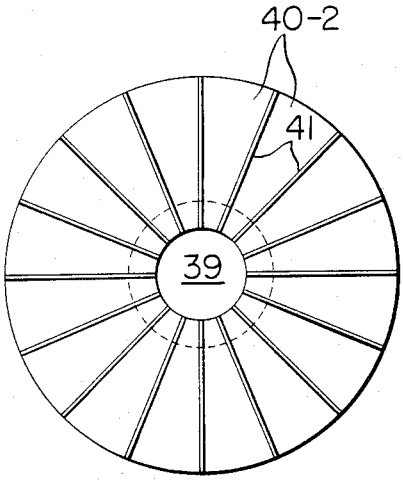
FIG. 15 is a front view of the end surface of the wrapper of FIG. 14.

Next, the motor 9 is started to close the arms 14 to the positions shown in broken lines in FIG. 3. As a result, the pusher plates 18 at the forward end of the arms 14 form the material into the folded end surface 40-2 as they rotate through 90 degrees from the position shown in solid lines to the position shown in broken lines in FIG. 3. In so rotating, the pusher plates 18 move against the force of the springs 20 using the corner of the coil as a fulcrum. As the plates 18 make their rotation, the pleat forming rods 27 therebetween are pressed down by the wrapping material against the force of the springs 29, whereby sixteen equally spaced pleats 41 are formed in the radially outward direction between the plates 18 (see FIGS. 12 and 13). When the plates 18 advance from the position shown in FIG. 8 to that of FIG. 9, the rods 27 are short enough so that they are disengaged from the pleats 41 to give rise to the form of wrapper as shown in FIGS. 14–15.

Figure 5:
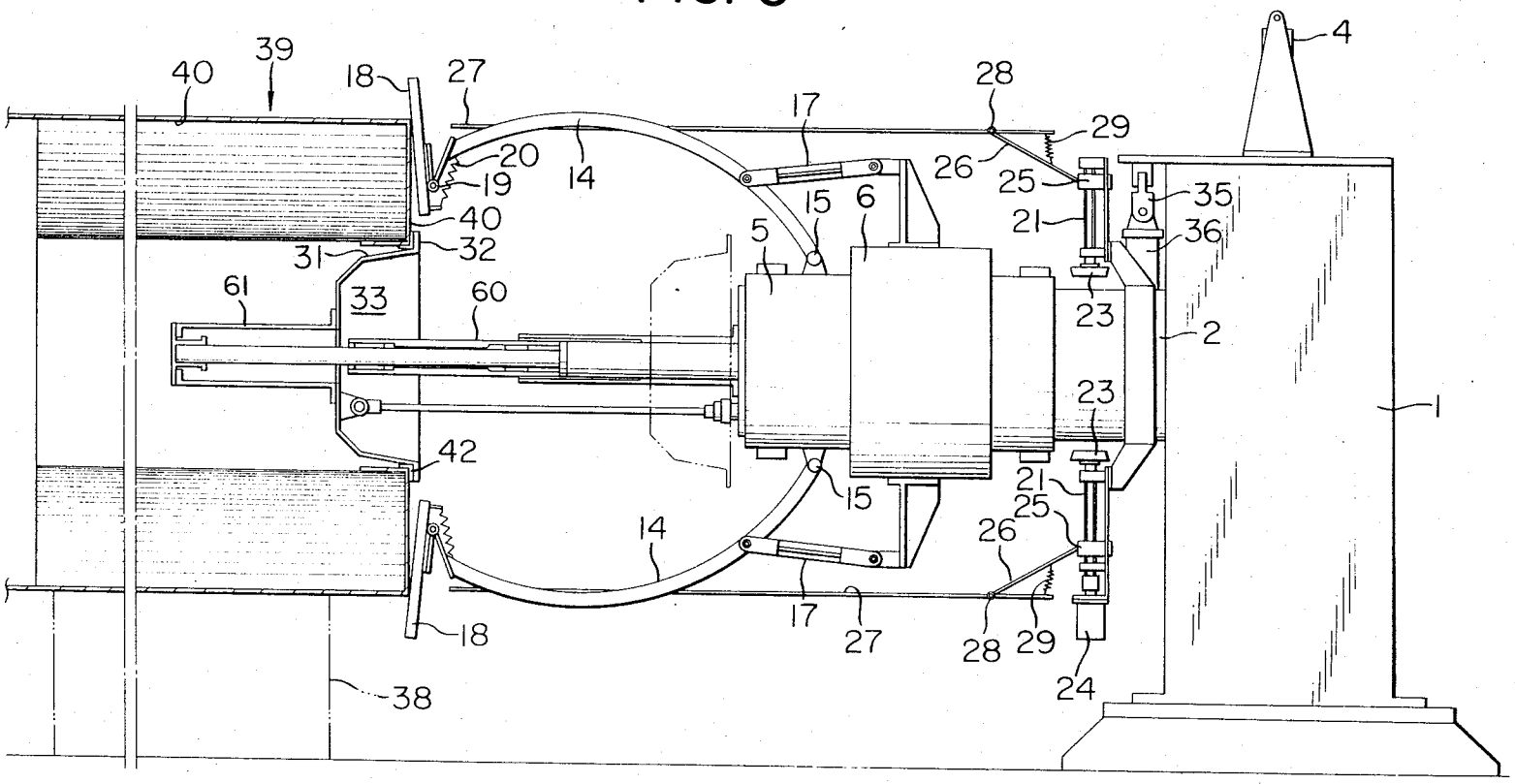
FIG. 5 is a side view similar to FIG. 3 fitting a ring into the central cylindrical void of the coil.
Figure 6:
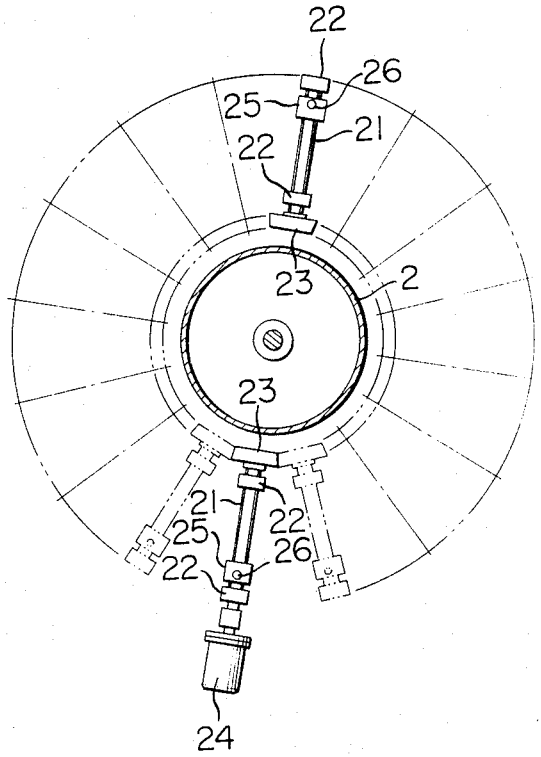
FIG. 6 is a front view taken along the line 6—6 of FIG. 3 showing means for operating a pleat forming rod.
Figure 7:
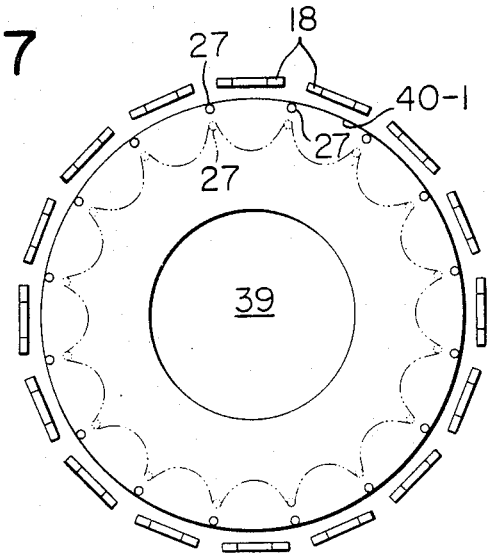
FIG. 7 is a view of the end surface of the coil taken along the line 7—7 of FIG. 3.
Figure 16:
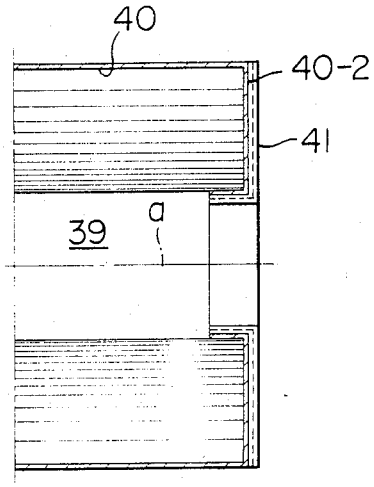
FIG. 16 is a view similar to FIG. 10 showing how the forward tips of the pleats are folded within the cylindrical void of the coil.
Figure 17:
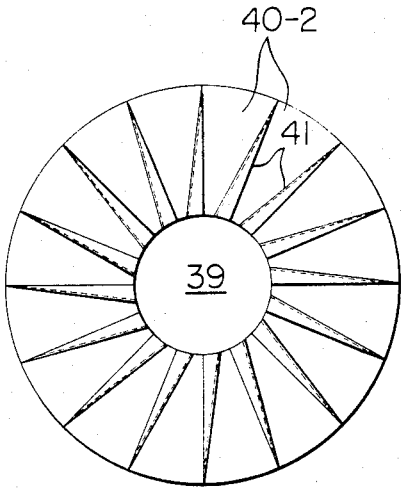
FIG. 17 is a front view of the end surface of the wrapper of FIG. 16.

Next, the rotatable member 5 is rotated in one direction to cause the sixteen plates 18 to slide over the end face of the coil and flatten the pleats 41 into the folded surface 40-2 as shown in FIGS. 16–17. Subsequently, the insert member 33 is advanced along the axis a as shown in FIG. 5 to fold the innermost edge of the folded surface 40-2 along the inside of the coil 39. Next, a retaining ring 42 fitted around the insert member 33 beforehand is pressed inside the coil 39 by the flange 32. Then the insert member 33 is withdrawn and the arms 14 are opened to the position shown in solid lines in FIG. 3, thus completing the wrapping operation and returning the apparatus to the state for starting the succeeding operation.

Next, another embodiment of the present invention will be described with reference to FIGS. 18–20.

In this embodiment, a plurality of coil stands 38 are arranged side by side on the floor 100. Horizontal rails 113 are laid parallel to the row of coil stands 38 on one or both sides thereof. A dolly 114 is mounted to run freely on the rails 113. Another pair of rails 115 is provided on the dolly 114 to run perpendicularly to the rails 113. A machine frame 106 is slidably supported on the rails 115.

A rotatable tubular member 107 rotatable around the horizontal axis a is provided on the machine frame 106 extending toward the coil stand 38. The horizontal axis a runs parallel to the horizontal rails 115 on the dolly 114.

The bases of arms 118 (sixteen arms in this embodiment) are pivotally mounted on the periphery of the rotatable member 107, and the outer faces of pusher plates 18 are pivotally mounted on hinges 111 on the forward ends of the arms 118.

The pusher plates 18 are urged by the force of springs 112 to protrude from the forward ends of the arms 118. Pleat forming rods 27 are disposed in the intermediate positions between adjacent pusher plates 18. The pleat forming rods 27 are pivotally mounted on the forward tip of parallel link arms 114, and tensioned by springs 116. The link arms 114 are moved up and down by pinions 117 disposed at their bases. The pinions 117 engage with a rack 218 by which the position of the pleat forming rods 27 is controlled.

An insert member 119 is provided at the forward end of the rotatable tubular member 107 in such manner that it can advance and retract freely toward and away from the coil stand 38, namely, in the direction of the axis a.

Figure 18:
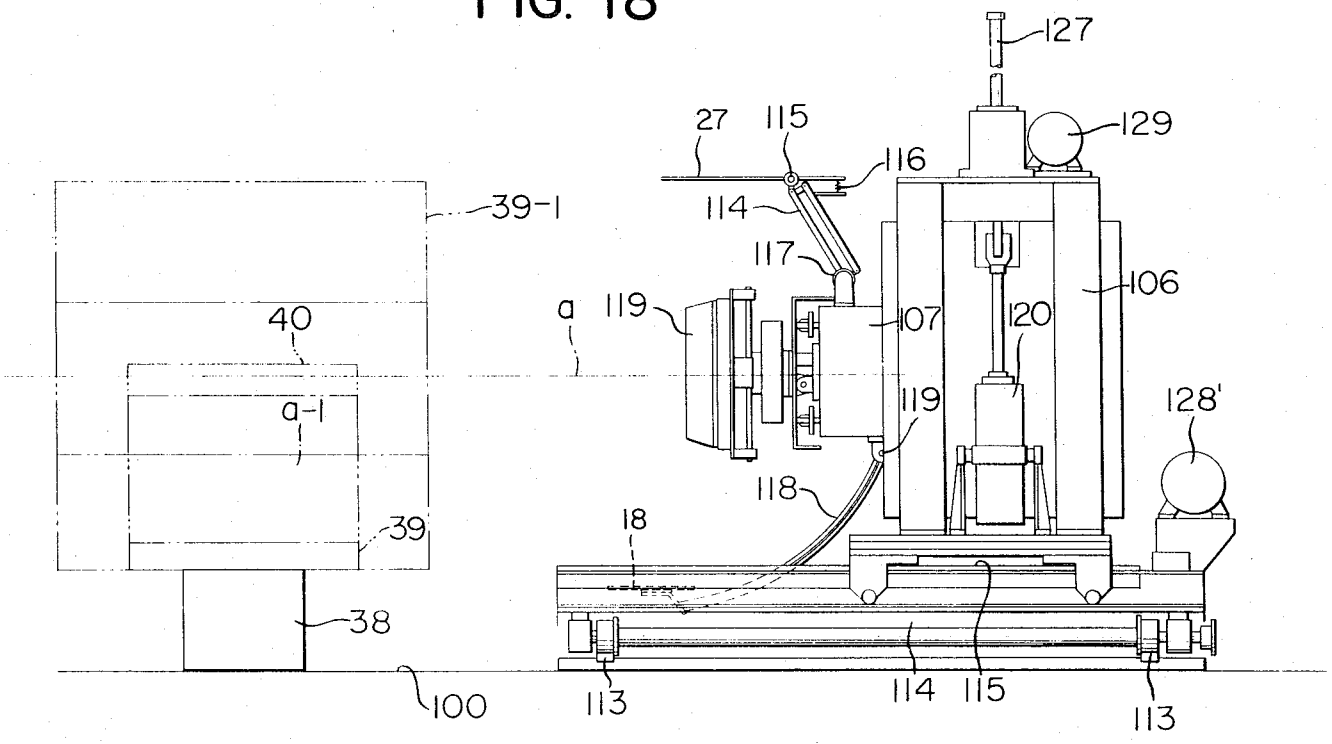
FIG. 18 is a side view of another apparatus for wrapping a coil in accordance with another embodiment of the invention.
Figure 19:
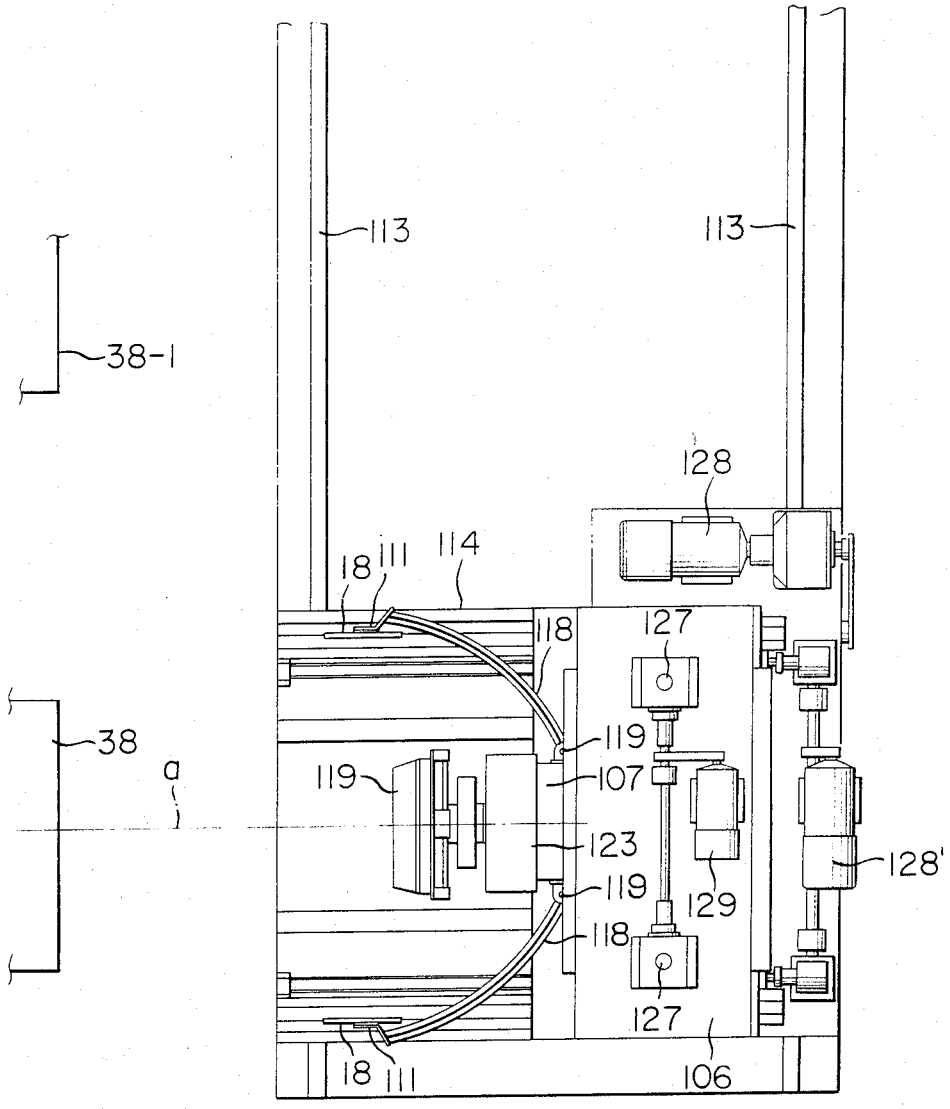
FIG. 19 is a plan view of the apparatus of FIG. 18.
Figure 20:
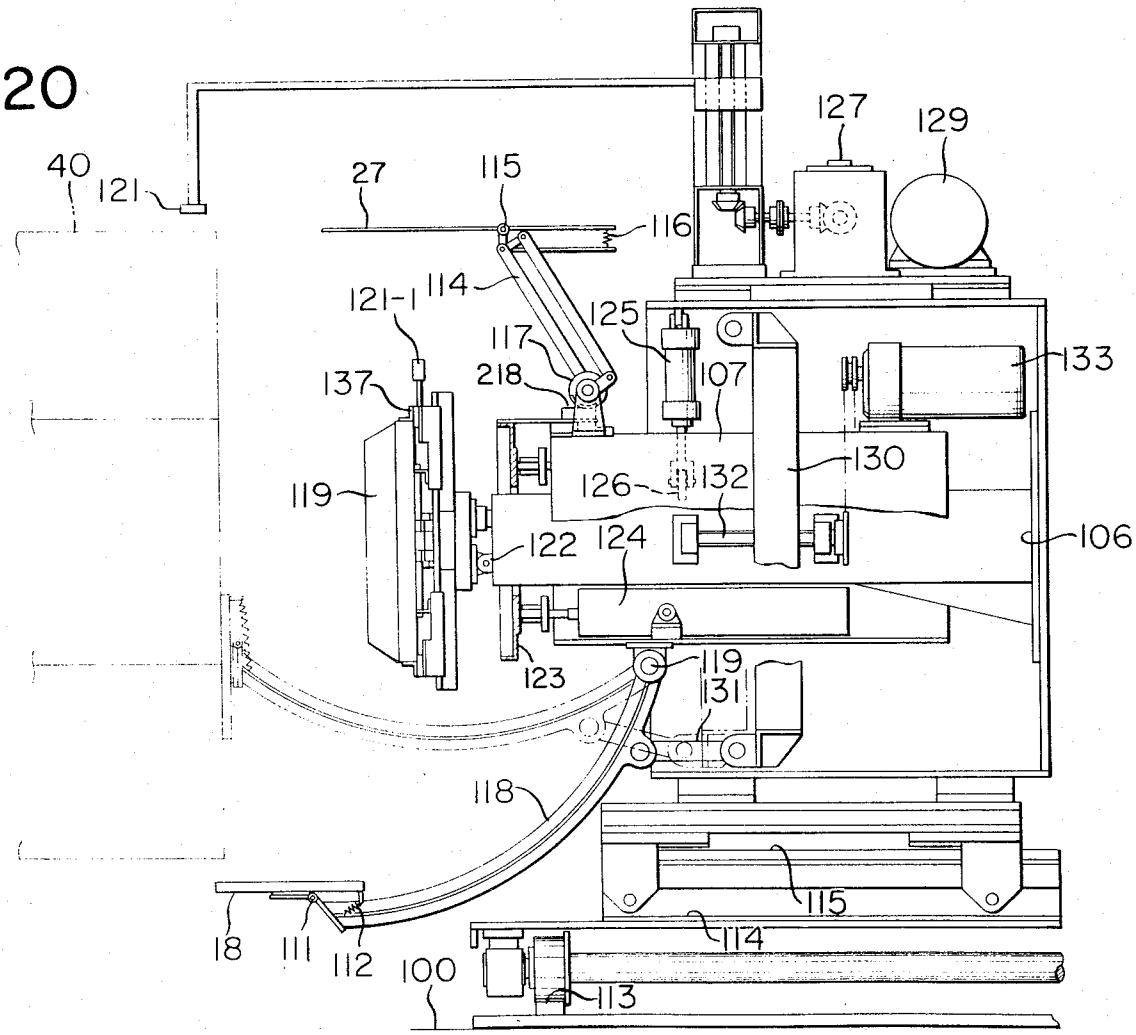
FIG. 20 is an enlarged detailed view of the apparatus of FIG. 18.

In FIGS. 18–20, in addition to the foregoing, there are shown a cylinder 120 for raising and lowering the rotatable tubular member 107, a proximity switch 121 for sensing the top of the coil, a proximity switch 121-1 for sensing the end surface of the coil, a cylinder 122 which operates to advance and retract the insert member 119 which penetrates into the cylindrical void of the coil, a member 123 for operating the rack 218, a cylinder 124 for operating the member 123, a cylinder 125 for lifting an arm 126 fixed to the rotatable member 107 and for rotating the rotatable member 107 clockwise and counterclockwise around its axis, a stop 127 for stopping the ascent of the member 107 which rises and falls in response to a signal from the proximity switch 121, an electric motor 128' for driving the dolly 114, a motor 129 for driving the stop 127 up and down, a sliding frame 130 for opening and closing the arms 118, a connecting rod 131 for connecting the arm 118 and the frame 130, a threaded rod 132 for sliding the frame 130, and a motor 133 for rotating the threaded rod.

In operation, the wrapping work is carried out in accordance with the second embodiment of the invention as follows:

A plurality of steel strip coils are placed on the stands 38 arranged side by side on the floor 100. Then the dolly 114 is moved along the horizontal rails 113 and stopped in front of a coil 39, whereafter the axis a-1 of the coil 39 and the horizontal axis a are aligned in the horizontal direction.

The machine frame 106 is then moved to the left in FIG. 18 along the rails 115 on the dolly 114. At an appropriate distance from the end of the coil 39, the machine frame is stopped and the rotatable member 107 is moved up or down to align the axis a-1 with the axis a in the vertical direction. The alignment in the horizontal and vertical directions can be carried out simultaneously if desired. Thereafter the machine frame 106 is moved further toward the coil 39 to position the pusher plates 18 around the periphery of the projecting portion 40-1 of the cylindrical wrapper 40 and to insert the pleat forming rods 27 inside the projecting portion 40-1.

In the above state, the arms 118 are closed from the position shown in solid lines to that shown in broken lines in FIG. 20, whereby the pusher plates 18 are rotated from the horizontal to the vertical position against the force of the springs 112 and the projecting portion 40-1 of the wrapper is folded onto the end surface of the coil as shown in FIGS. 12–15.

During the folding action, the pleat forming rods 113 are first depressed against the force of the springs 116 so that they disengage from the projecting portion 40-1 and then snap back to their original horizontal position under the force of the springs 116. Subsequently, the cylinder 125 is operated to rotate the rotatable member 107 to the left as indicated in FIG. 15, whereby the pusher plates 18 are slid along the end surface of the coil to fold the pleats of the wrapping material which have been formed between adjacent pusher plates 18 as illustrated in FIG. 17.

Thereafter the cylinder 122 is operated to advance the insert member 119 to the left in FIG. 20, whereby the projecting portion 40-1 is folded into the inside of the coil. A retaining ring member 137 fitted around the insert member 119 beforehand is thus inserted into the inside of the coil with the forward tip of the projecting portion 40-1 pressed underneath the insert member 119.

Finally, the insert member 119 is withdrawn, the machine frame 106 is moved to the right in FIG. 20 along the rails 115, and the dolly 114 is moved to the next coil to be wrapped, whereafter another wrapping operation as described above is carried out.

As fully described in the foregoing, in accordance with the embodiments of the present invention, the projecting portion of the cylindrical wrapper which completely wraps a coiled steel strip can be simply and automatically folded onto both end surfaces of the coil.

Furthermore, the wrapping apparatus according to this invention can be moved with respect to a plurality of coils of different diameters arranged in a row on the floor 100 so as to sequentially align the axis of the apparatus with the axis of the coil in both the horizontal and the vertical direction, whereby wrapping of coils of various diameters can be carried out.

We claim:

1. A method of using an apparatus for wrapping with a sheet of wrapping material different sized cylindrically shaped coils of steel strip having a cylindrical peripheral surface, two end surfaces and a hollow cylindri cal central space, said apparatus having a cylindrical member having a horizontal axis mounted on a frame and projecting therefrom, a horizontal rotatable member rotatably mounted on said cylindrical member for rotation therearound, a plurality of arms having their base ends mounted on the periphery of said rotatable member and having free ends extending beyond the end of said cylindrical member away from said frame and movable in a path from a position corresponding to the outer peripheral surface of the largest size coil to be wrapped to a position near the center of the smallest size coil to be wrapped, a plurality of pusher plates, one pivotably mounted on the free end of each of said arms at a point along the length of the pusher plate adjacent the end thereof closer to said cylindrical member and pivotable between a rest position substantially parallel to the axis of said cylindrical member to a position substantially perpendicular to said axis, spring means connected to each of said pusher plates for pivotally urging each of said pusher plates to said rest position, and a plurality of pleat forming rods on said apparatus extending parallel to the axis of said cylindrical member with a pleat forming rod midway between each pair of adjacent pusher plates, said pleat forming rods being movable radially of the axis of said cylindrical member, said method comprising:

wrapping a sheet of the wrapping material around the cylindrical peripheral surface of the coil to be wrapped with the ends of the sheet projecting beyond both ends of the coil a distance which is greater than the thickness of the coil between the peripheral surface and the hollow space;

moving the apparatus to a position opposed to the end of the coil and moving said arms for moving the ends along said path until said pusher plates are brought into contact with the outer peripheral surface of the wrapper around the coil at a position where a substantial portion of the length thereof is against the wrapper on the peripheral surface of the coil and the pivotal mounting point of said plates is spaced axially away from the end surface of the coil toward said cylindrical member;

inserting the plurality of pleat forming rods into the inside of one projecting end of the wrapping material in a direction parallel to the cylindrical axis of the coil, and bringing the pleat forming rods into contact with the inside of the projecting end of the wrapping material;

moving said arms further for further moving said pusher plates for pivoting the pusher plates around said points from their parallel position to the perpendicular position against the coil end surface while they remain substantially in contact with the wrapper and the corner of the coil to draw the wrapper over the corner of the coil and fold it against the end surface of the coil and causing the pleat forming rods to form radial pleats in the wrapping material; and moving said arms circumferentially of the end of the coil for sliding the pusher plates circumferentially of the end surface of the coil for flattening all the pleats against the end surface in the same direction.

2. A method as claimed in claim 1 further comprising inserting a cylindrical insert member which just fits into the cylindrical space and having a retaining ring around the outside thereof into the cylindrical space, and bringing the retaining ring into contact with the flattened pleats to retain the pleats between the retaining ring and the coil.

3. An apparatus for wrapping with a sheet of wrapping material different sized cylindrically shaped coils of steel strip having a cylindrical peripheral surface, two end surfaces and a hollow cylindrical central space, said apparatus comprising:

a frame;

a cylindrical member having a horizontal axis mounted on said frame and projecting therefrom;

a horizontal rotatable member rotatably mounted on said cylindrical member for rotation therearound;

a plurality of arms having their base ends pivotally mounted at a fixed position on the periphery of said rotatable member and having free ends extending beyond the end of said cylidrical member away from said frame and movable in a path from a position corresponding to the outer peripheral surface of the largest size coil to be wrapped to a position near the center of the smallest size coil to be wrapped;

a plurality of pusher plates, one pivotably mounted on the free end of each of said arms at a point along the length of the pusher plate adjacent the end thereof closer to said cylindrical member and pivotable between a rest position substantially parallel to the axis of said cylindrical member to a position substantially perpendicular to said axis;

spring means connected to each of said pusher plates for pivotally urging each of said pusher plates to said rest position;

a plurality of pleat forming rods on said apparatus extending parallel to the axis of said cylindrical member with a pleat forming rod midway between each pair of adjacent pusher plates, said pleat forming rods being movable radially of the axis of said cylindrical member from a radially outermost position corresponding to the outer peripheral surface of the largest size coil to be wrapped at least to a position corresponding to the outer peripheral surface of the smallest coil to be wrapped; and means connected to said arms for moving said arms to move the free ends thereof in said paths so that said pusher plates are brought into contact with the outer peripheral surface of the wrapper around the coil at a position where a substantial portion of the length thereof is against the wrapper on the peripheral surface of the coil and the pivotal mounting point of said plates is spaced axially away from the end surface of the coil toward said cylindrical member, and upon further movement of said arms the pusher plates pivot from their parallel position to the perpendicular position against the coil end surface while remaining substantially in contact with the wrapper and the corner of the coil to draw the wrapper over the corner of the coil and fold it against the end surface, and means connected to said rotatable member for rotating said rotatable member and means connected to said pleat forming rods for moving said pleat forming rods radially of the axis of said cylindrical member.

4. An apparatus as claimed in claim 3 in which said horizontal member is a tubular horizontal member, and an insert carrying member mounted in said horizontal member for reciprocal movement along the axis thereof for carrying an insert member for inserting it into the central space of the coil, and means connected to said insert carrying member for reciprocally moving said insert carrying member.

5. An apparatus as claimed in claim 3 wherein said frame is movable in the direction of said axis of said horizontal member and in a direction perpendicular thereto, whereby the apparatus can be moved toward and away from a coil to be wrapped and moved along a row of coils to be wrapped.

6. An apparatus as claimed in claim 5 further comprising a first pair of rails extending perpendicular to the axis of said horizontal member, a dolly movably mounted on said first pair of rails, a second pair of rails on said dolly perpendicular to said first pair of rails, and said frame being movably mounted on said second pair of rails.

* * * * *